US006078677A

United States Patent [19]

Dolleman et al.

[11] Patent Number: 6,078,677

[45] Date of Patent: Jun. 20, 2000

[54] ELECTROACOUSTIC TRANSDUCER WITH IMPROVED DIAPHRAGM ATTACHMENT

[75] Inventors: Henk Dolleman; Onno Geschiere, both of Amsterdam; Paul Christiaan Van Hal, Hoorn; Engbert Wilmink, Delft, all of Netherlands

[73] Assignee: Microtronic Nederlands B.V., Netherlands

[21] Appl. No.: 08/994,745

[22] Filed: Dec. 19, 1997

[30] Foreign Application Priority Data

Dec. 23, 1996 [NL] Netherlands ..... 1004877

[51] Int. Cl.[7] ..... H04R 25/00

[52] U.S. Cl. ..... 381/418; 381/417

[58] Field of Search ..... 381/322, 417, 381/418

[56] References Cited

U.S. PATENT DOCUMENTS

| | | | |
|---|---|---|---|
| 2,794,862 | 6/1957 | Topholm . | |
| 3,560,667 | 2/1971 | Carlson | 381/417 |
| 3,573,397 | 4/1971 | Sawyer et al. . | |
| 3,588,383 | 6/1971 | Carlson | 381/417 |
| 3,742,156 | 6/1973 | Broersma . | |
| 3,935,398 | 1/1976 | Carlson | 381/417 |
| 4,109,116 | 8/1978 | Victoreen . | |
| 4,272,654 | 6/1981 | Carlson | 381/418 |
| 4,410,769 | 10/1983 | Tibbetts . | |
| 4,728,934 | 3/1988 | Pfänder et al. . | |

FOREIGN PATENT DOCUMENTS 2 229 339 9/1990 United Kingdom .

*Primary Examiner*—Curtis A. Kuntz
*Assistant Examiner*—Phylesha Dabney
*Attorney, Agent, or Firm*—Michaelson & Wallace; Peter L. Michaelson

[57] ABSTRACT

An electroacoustic transducer having a housing with at least two parts, e.g., a cover and a bottom portion, and a diaphragm situated therein. Specifically and illustratively, an edge portion of the diaphragm is attached to one of two opposing edges of side walls of the cover and the bottom portion and, once the housing is assembled, is located between these edges. The edge to which the diaphragm is attached extends in a first plane defined by a central portion of the diaphragm or in a second plane parallel thereto.

6 Claims, 2 Drawing Sheets

ELECTROACOUSTIC TRANSDUCER WITH IMPROVED DIAPHRAGM ATTACHMENT

FIELD OF THE INVENTION

The invention relates to an electroacoustic transducer comprising a housing, a diaphragm received within the housing, the diaphragm comprising a central diaphragm portion and an edge portion extending around it, means for converting an electric signal into a vibration of the central diaphragm portion or converting a vibration of the central diaphragm portion into an electric signal, the edge portion of the diaphragm being attached to a wall portion of the housing.

DESCRIPTION OF THE PRIOR ART

Such a transducer is known, e.g. from Dutch patent application 89.00613, and is used, e.g., in a hearing aid.

The operation of such a transducer is based on the effect that the capacity of a capacitor depends on the mutual distance between the capacitor plates. If as a result of, e.g., sound vibrations one of those plates is set vibrating, thereby varying the effective distance between the plates, the capacity varying as a result thereof can be detected as an electric signal. A frequently used embodiment of an electroacoustic transducer is of the so-called electret type in which one of the capacitor plates is provided with a predetermined amount of charge. The transducer known from the above Dutch patent application is an example of such an electroacoustic transducer of the electret type. The present invention will hereinbelow be elucidated specifically for such an electroacoustic transducer of the electret type, but it is explicitly observed that the invention is not limited thereto.

Such a transducer generally comprises a substantially closed case provided with an opening through which the interior of the case can communicate with the surroundings. Received within the case is a microphone capsule which, in the above case of the electret type, is designated as electret system comprising a so-called backplate as well as a diaphragm arranged near the backplate, which diaphragm is at least partly provided with a conductive layer. The electret system further comprises an electret layer which can be arranged on the backplate or on the diaphragm; the diaphragm can even be manufactured from electret material.

When sound waves enter the case, the diaphragm is set vibrating, thereby generating, through the combination of the diaphragm and the backplate, an electric signal which is representative of the sound waves and capable of being presented to an amplifier for further processing.

For a proper functioning of such a transducer, the structure of, inter alia, the diaphragm has to comply with different requirements. On the one hand, the diaphragm needs to be free to move, on the other hand, it is of course necessary to attach the diaphragm in some way or other. It is therefore usual to attach the diaphragm with its circumferential edge to a supporting frame or to the housing, while the central portion of the diaphragm is left clear to enable vibrations. A groove- or bellows-shaped transition portion is often interposed between the central diaphragm portion and the edge portion to give the central diaphragm portion as much freedom of vibration as possible.

As stated before, an acoustic transducer is used, e.g., in hearing aids which are intended to be positioned in the external auditory canal of a person. In this field, advancing miniaturization is therefore continuously pursued.

Also, apart from the pursuit of miniaturization, it is desirable to provide a highest possible sensitivity of the diaphragm, for which it is desirable that the surface of the central diaphragm portion is as large as possible. Moreover, it is desirable to enable the manufacture of the structure of the diaphragm to be as inexpensive as possible by using as few parts as possible. For these reasons the use of a frameshaped carrier for mounting the diaphragm is less desirable.

In the electroacoustic transducer as described in Dutch patent application 89.00613 an edge portion of the diaphragm bent at rights angles is glued to the inner wall of the housing. This actually provides the advantage of a largest possible surface of the central diaphragm portion. Yet some, drawbacks are connected with this technique of attachment.

In the first place, the housing has no points of reference for the attachment of the diaphragm. This renders it difficult for the level at which the central diaphragm portion will be located within the housing, i.e. the vertical position perpendicular to the diaphragm surface, to be preadjusted with certainty and to be obtained accurately and reproducibly during manufacture. A related problem lies in the fact that it is difficult to ensure the same level of attachment along the entire circumference of the folded edge portion of the diaphragm. Consequently, the attached diaphragm may show a certain torsion and/or inclination, which affects the acoustic quality while the required overall height for the diaphragm in its entirety is increased.

In the second place, it is difficult to ensure that the glue will only be applied between the folded edge portion of the diaphragm and the inner wall of the housing. It is practically inevitable that either too little glue is present between the folded edge portion of the diaphragm and the inner wall of the housing or excess glue extends from the inner wall of the housing to the transition portion. This, in turn, renders it difficult to maintain a desired degree of flexibility of the attachment of the central diaphragm portion relative to the housing. In extreme cases, it may occur that the transducer must be regarded as waste.

In the third place, it is difficult to connect the diaphragm, glued to a housing part, to the actuator received within the housing.

SUMMARY OF THE INVENTION

For this reason, it is a general object of the present invention to increase the reliability of an electroacoustic transducer while maintaining a largest possible diaphragm surface.

In particular, it is an object of the present invention to provide an electroacoustic transducer, the assembly of which may be easier and more reliable and has a higher degree of reproducibility.

To achieve these objects, the invention provides an electroacoustic transducer of the above type, characterized in that the edge portion of the diaphragm extends in the plane defined by the central diaphragm portion or in a plane parallel thereto and is attached to an edge portion of a side wall of a housing part which extends in the plane defined by the central diaphragm portion or in a plane parallel thereto.

According to an important aspect of the invention the edge portion of the diaphragm intended for attachment is not folded at right angles and attached to a wall portion of the housing being at right angles to the diaphragm surface but is attached to an edge portion of a housing part directed parallel to the plane of the diaphragm surface and preferably located in the plane of the diaphragm surface. The edge portion of the housing, which defines the level of the diaphragm by the method of attachment proposed according to the present invention, can be flattened with rather significant precision and reproducibility. Moreover, metering and localizing the glue is simplified because the glue can simply be applied to the edge portion of the housing before mounting the diaphragm.

BRIEF DESCRIPTION OF THE DRAWINGS

These and other aspects, features and advantages of the present invention will be illustrated by the following description of a preferred embodiment of an electroacoustic transducer according to the invention in which.

DETAILED DESCRIPTION

Figure 1A:
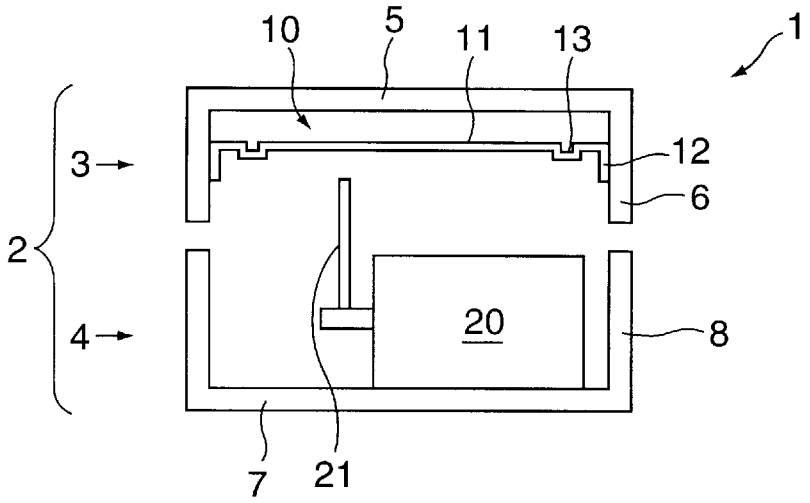
FIG. 1A is a diagrammatic cross-sectional view of a known electroacoustic transducer.

The present invention will be briefly explained with reference to FIGS. 1A and 1B. A known electroacoustic transducer is designated generally therein by reference numeral 1, while an electroacoustic transducer having the structure proposed by the present invention is designated generally therein by reference numeral 100. Besides, similar or comparable parts in the figures are designated by the same reference numerals.

The electroacoustic transducer 1 comprises a housing 2 consisting of two parts, namely a first housing part 3 and a second housing part 4. The housing 2 generally has the shape of a rectangular case, and the two housing parts 3 and 4 generally have a substantially U-shaped cross-section, the concave sides of the housing parts 3 and 4 being directed towards each other and, in assembled form, enclosing the interior of the housing 2. The first housing part 3 will hereinbelow also be designated by the term "cover", and the second housing part 4 will hereinbelow also be designated by the term "lower case". The cover 3 has a top wall 5 with a substantially rectangular cross-section and four side walls 6 which are substantially at right angles to the top wall 5 and to each other. In a comparable manner, the lower case 4 has a bottom 7 with a substantially rectangular cross-section and four side walls 8 which are substantially at right angles to the bottom 7 and to each other.

Received within the interior of the housing 2 is a diaphragm 10. The diaphragm 10 has a central diaphragm portion 11 and an edge portion 12 extending around it and intended for attachment of the diaphragm 10 to the housing 2. Between the central diaphragm portion 11 and the edge portion 12 the diaphragm 10 has a transition portion 13 which may be formed as a pattern of folds.

Mounted on the lower case 4 is an actuator 20 which is coupled to the central diaphragm portion 11 via a movement transmitter 21, which will hereinbelow also be designated by the term "fork".

As clearly shown in FIG. 1A, in the known electroacoustic transducer 1 the edge portion 12 of the diaphragm 10 is folded down at right angles, and the edge portion 12 is glued to the inner surface of the side wall 6 of the cover 3, which has the drawbacks mentioned in the introduction. FIG. 1A shows the transducer 1 in a situation in which the cover 3 is not yet attached to the lower case 4, while the fork 21 is not yet attached to the central diaphragm portion 11; it will be clear that during assembly of the transducer 1 the attachment of the fork 21 to the central diaphragm portion 11 meets with difficulties.

Figure 1B:
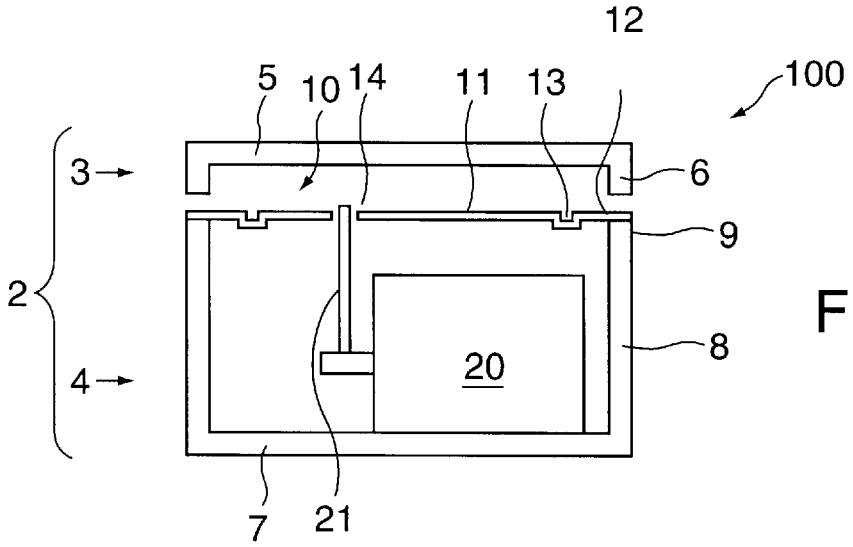
FIG. 1B is a cross-sectional view, comparable to FIG. 1A, of an electroacoustic transducer according to the present invention.

As shown in FIG. 1B, in the electroacoustic transducer 100 according to the present invention the edge portion 12 of the diaphragm 10 is not folded down at right angles, but the edge portion 12 of the diaphragm 10 is in a plane parallel to the plane defined by the central diaphragm portion 11. In particular, the edge portion 12 and the central diaphragm portion 11 are in alignment, as shown, but this is not necessary.

The edge portion 12 of the diaphragm 10 is attached, e.g. by means of gluing, to the free end edge 9 of the side walls 8 of the lower case 4. The free end edge 9 defines a surface suitable for attachment of the edge portion 12 of the diaphragm 10, the width of which surface is defined by the thickness of the side walls 8 of the lower case 4.

Such a method of attachment has a number of advantages. In the first place, the lower case 4 can be manufactured with rather significant precision. Moreover, in particular, it is relatively simple to manufacture the lower case 4 in a manner such that the four edges 9 of the four side walls 8 of the lower case 4 are located in a plane directed parallel to the bottom 7, while, also, the distance from that plane defined by the edges 9 to the bottom 7 can be adjusted accurately, if required by finishing the edges 9. Consequently, according to the present invention, it is ensured in a relatively simple manner that the diaphragm 10 attached to the edges 9 is directed parallel to the bottom 7, without torsion and/or inclination, and that the level of the diaphragm 10, i.e. the 5 distance from the diaphragm 10 to the bottom 7, can be preadjusted accurately.

In the second place, it is relatively simple to ensure that the glue is only applied to the diaphragm portions involved in the attachment of the diaphragm, namely by applying the glue to the edges 9 and then placing the diaphragm 10. The risk that glue may end up on the transition portion 13 has now become very low.

In the third place, connecting the central diaphragm portion 11 with the actuator received within the housing has been simplified. A connecting method which has been found capable of good results is as follows. The central diaphragm portion 11 is provided with an opening 14, the position of which corresponds to the position of the fork 21. The length of the fork 21 is chosen such that when arranging the diaphragm 10 the free end of the fork 21 extends through the opening 14. From the top side, both the diaphragm 10 and the free end of the fork 21 are now accessible, so that the diaphragm 10, during or after arrangement thereof, can be attached by, e.g., gluing, to the end of the fork 21. Subsequently, the cover 3 can be attached to the combination of the lower case 4 and the diaphragm 10.

As described above, the attachment of the diaphragm 10 to the frame-shaped carrier received within the housing 2 has the drawback that the effective surface of the central diaphragm portion 11 is reduced. On the other hand, the attachment of the diaphragm 10 to a frame-shaped carrier has in itself the advantage that it is possible to manufacture in a separate manufacturing step a diaphragm/carrier combination, which combination is easier to handle during attachment to the housing 2. The present invention provides an embodiment which combines these advantages of a diaphragm/carrier combination with the above-discussed advantages of attachment of the diaphragm 10 to an edge portion 9. An example of such an embodiment is diagrammatically illustrated in FIG. 1C. As compared to the embodiment illustrated in FIG. 1B, the embodiment of FIG. 1C can be different, because the housing 2 is subdivided into three housing parts, namely a cover 3, a lower case 24 and an intermediate housing part 25. The lower case 24 comprises a bottom 7 and four side walls 26, which are substantially at right angles to the bottom 7 and to each other. An intermediate housing part 25 generally has the shape of a rectangular frame and comprises four side walls 28, which are substantially at right angles to each other, the lengths of the side walls 28 corresponding to the lengths of the side walls 26. The total height of the side walls 26 and the side walls 28 can be equal to the height of the side walls 8 of the lower case 4 of FIG. 1B.

Figure 1C:
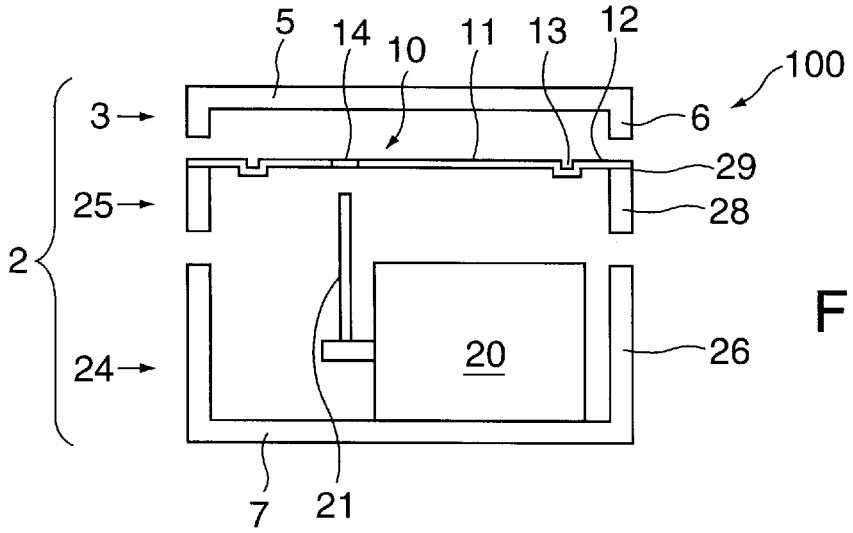
FIG. 1C is a cross-sectional view, comparable to FIG. 1B, of a variant of the transducer according to the present invention.

As shown in FIG. 1C, the diaphragm 10 is attached to the upper edges 29 of the intermediate housing part 25. During manufacture of a transducer according to this embodiment there is first made, on the one hand, a bottom/actuator combination comprising the lower case 24 and the actuator 20 mounted thereon, and on the other hand, an intermediate housing part/diaphragm combination comprising the intermediate housing part 25 and the diaphragm 10 attached thereto. Subsequently, the intermediate housing part/diaphragm combination is attached to the bottom/actuator combination, in which the fork 21 can be attached via an opening 14 to the central diaphragm portion 11 in the manner discussed before. Finally, the cover 3 can be placed.

Figure 2:
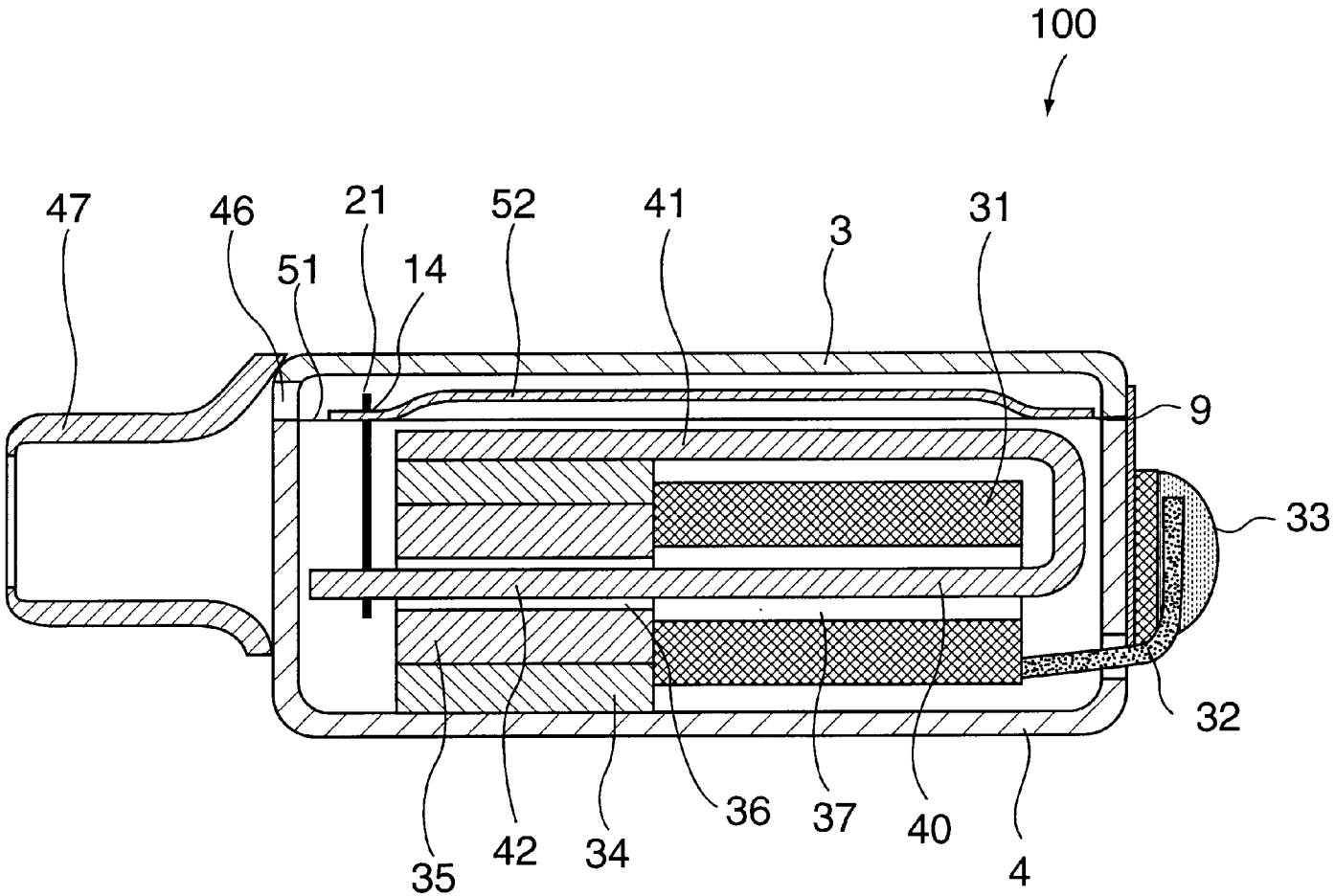
FIG. 2 is a more detailed cross-sectional view of a preferred embodiment of an electroacoustic transducer according to the present invention.

FIG. 2 shows a more detailed longitudinal section of a preferred embodiment of an electroacoustic transducer 100 according to the present invention, which longitudinal section is comparable to the longitudinal section of FIG. 3 of the above-mentioned Dutch patent application 89.00613.

Since the nature and structure of the actuator 20 is not a subject of the present invention and knowledge thereof is not necessary for those skilled in the art to properly understand the present invention, while, moreover, a known per se actuator can be used, this will be only briefly described. The actuator 20 comprises an electric coil 31 which is connected via an electric line 32 extending through the lower case 4 to terminals 33 mounted on the outer surface of the housing 2. Placed within a magnet housing 34 is a magnetic member 35. An air gap 36 of the magnetic member 35 is aligned with an air gap 37 of the coil 31. A U-shaped armature 40 has a first leg 41 attached to the magnet housing 34 and a second leg 42 extending into the aligned air gaps 36 and 37. Attached to the end of the second leg 42 is the fork 21.

If an externally generated current is presented to the coil 31, a force is exerted on the armature 40 by the magnetic field generated by the magnetic member 35. As a result thereof, a displacement is generated in the longitudinal direction of the fork, thereby moving the diaphragm to generate a pressure wave.

The cover 3 has an opening 46 through which the interior of the housing 2 between the cover 3 and the diaphragm 10 communicates with the outside world. Attached to the housing is a substantially cylindrical nozzle 47 to which, if desired, a flexible tube can be fastened for guiding pressure waves.

FIG. 2 clearly shows that the diaphragm 10 may have a layered structure. More in particular, the diaphragm 10 comprises a thin flexible foil 51 and a reinforcement layer 52 attached thereto, e.g. by gluing. The reinforcement layer 52 has a thickness exceeding that of the foil 51 and has a surface defining the central diaphragm portion 11. The part of the foil 51 projecting beyond the reinforcement layer 52 defines the edge portion 12.

It will be clear to those skilled in the art that the scope of protection of the present invention as defined by the claims is not limited to the embodiments discussed and shown in the figures, but that it is possible to change or modify the embodiments shown of the transducer according to the invention within the scope of the inventive concept. Thus, for instance, it is possible that the fork 21 does not extend through the opening 14, but that the end of the fork 21 is located near of the opening 14.

It is also possible that the diaphragm 10 is not provided with an opening 14. The end of the fork 21 is located near the diaphragm 10 and is attached to the diaphragm during assembly by applying at the bottom of the diaphragm a drop of glue in the right position, which drop touches the fork when arranging the diaphragm. Such a method of attachment is particularly suitable in connection with a diaphragm 10, the edge portion 12 of which is attached to the edge of the side wall 6 of the cover 3.

Also possible is a structure in which the diaphragm does not communicate with the armature, e.g. in the case of an electret microphone, in which case the attachment of the edge portion 12 of the diaphragm 10 to the edge of the side wall 6 of the cover 3 even offers advantages.

We claim:

1. An electroacoustic transducer comprising:

a housing having first and second housing parts;

a diaphragm, received within the housing, comprising a central diaphragm portion and an edge portion extending around the central diaphragm portion; and means for converting either an electric signal into vibration of the central diaphragm portion or vibration of the central diaphragm portion into an electric signal;

wherein:

the edge portion of the diaphragm is made from at least a part of material that forms the central diaphragm portion, extends in a first plane defined by the central diaphragm portion or in a second plane parallel to the first plane and is attached to an edge portion of a side wall of the first housing part; and the edge portion of the diaphragm is located between two opposing edge portions of the first and second housing parts.

2. The electroacoustic transducer recited in claim 1 wherein the edge portion of the side wall, to which the diaphragm is attached, is located in a plane oriented parallel to a bottom of a lower case of the housing.

3. The electroacoustic transducer recited in claim 2 wherein:

the converting means comprises a fork and is mounted in the lower case of the housing; and the edge portion of the side wall to which the diaphragm is attached forms part of either the lower case or a frame-shaped intermediate housing part attached to the lower case.

4. The electroacoustic transducer recited in claim 3 wherein:

the central diaphragm portion has an opening; and the end of the fork is located proximate to or extends through the opening.

5. The electroacoustic transducer recited in claim 1 wherein the edge portion of the side wall, to which the diaphragm is attached, forms part of an intermediate housing part, the intermediate housing part constituting the first housing part.

6. The electroacoustic transducer recited in claim 1 wherein the edge portion of the diaphragm is attached to an edge portion of a side wall of a cover of the housing, the cover constituting the second housing part.

* * * * *